US007495620B2

(12) United States Patent
Wang et al.

(10) Patent No.: US 7,495,620 B2
(45) Date of Patent: Feb. 24, 2009

(54) ANTENNA

(75) Inventors: Hanyang Wang, Oxfordshire (GB); Ming Zheng, Hampshire (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/101,227

(22) Filed: Apr. 7, 2005

(65) Prior Publication Data

US 2006/0227054 A1 Oct. 12, 2006

(51) Int. Cl.
*H01Q 1/24* (2006.01)

(52) U.S. Cl. ..... 343/702

(58) Field of Classification Search ..... 343/702, 343/700 MS, 711, 846, 872, 873
See application file for complete search history.

(56) References Cited

U.S. PATENT DOCUMENTS 5,966,097 A * 10/1999 Fukasawa et al. ..... 343/700 MS
6,894,650 B2 * 5/2005 Darden et al. ..... 343/702
6,911,944 B2 * 6/2005 Sekine et al. ..... 343/702
6,922,172 B2 * 7/2005 Oshiyama et al. ..... 343/700 MS
2004/0051669 A1 * 3/2004 Rutfors et al. ..... 343/702
2004/0150563 A1 * 8/2004 Oshiyama et al. ..... 343/700 MS
2005/0190107 A1 * 9/2005 Takagi et al. ..... 343/702
2006/0044196 A1 * 3/2006 Grant et al. ..... 343/713

FOREIGN PATENT DOCUMENTS

EP 1 202 386 A2 5/2002
GB 2403069 A * 12/2004
WO WO 2004/038857 A1 5/2004

* cited by examiner

*Primary Examiner*—Huedung Mancuso
(74) *Attorney, Agent, or Firm*—Harrington & Smith, PC

(57) ABSTRACT

An antenna arrangement including a first antenna element having a first portion and a first feed; and a second antenna element having a second portion and a second feed, different to the first feed, wherein the first antenna element and the second antenna element are relatively arranged and oriented so that the first portion and the second portion run in parallel separated by a gap and so that electric currents generated in the first portion and the second portion travel in substantially the same directions at substantially the same times.

25 Claims, 3 Drawing Sheets

ANTENNA

FIELD OF THE INVENTION

Embodiments of the present invention relate to an antenna. In particular they relate to the isolation of antennas having overlapping resonant frequencies.

BACKGROUND TO THE INVENTION

The PCS and WCDMA frequency bands overlap in the USA. This causes problems in dual mode telephones that can operate in either mode.

A dual mode telephone will typical have one antenna for PCS and another for WCDMA. However, because of the overlapping frequency bands, when one antenna is used, the other unused antenna absorbs power from the used antenna which degrades its receiving and transmitting performance. This problem can be solved by isolating the antennas. One way of doing this is to space the antennas far apart, but this is undesirable as it increases the space required for the antennas and the size of the device housing them.

BRIEF DESCRIPTION OF THE INVENTION

It would therefore be desirable to devise another way of isolating two antennas. Such isolation would allow antennas that operate with overlapping frequency bands to be placed in relative proximity.

According to one aspect of the invention there is provided an antenna arrangement comprising: a first antenna element having a first portion and a first feed; and a second antenna element having a second portion and a second feed, different to the first feed, wherein the first antenna element and the second antenna element are relatively arranged and oriented so that the first portion and the second portion run in parallel separated by a gap and so that electric currents generated in the first portion and the second portion travel in substantially the same directions at substantially the same times.

Typically, the first and second feeds are independent allowing the first and second antenna elements to transmit/receive independently.

The first antenna element may have a first ground pin connected to a ground plane and the second antenna element may have a second ground pin connected to the ground plane and the first and second ground pins may be separated by a distance such that the electric current in the first portion and the electric current in the second portion travel in the same direction at the same time.

The first antenna element may: extend from a first grounded end to a first terminating free end; be located in the two thirds of the first antenna element nearest the first terminating free end; and extend in a first sense from a part of the first portion nearest the first grounded end to a part nearest the first terminating end. The second antenna element may extend from a second grounded end through the second portion to a second terminating free end. The second portion may extend in the first sense. A lag of 180 degrees may exist between the grounded ends of the first and second antenna elements.

According to another aspect of the invention there is provided an antenna arrangement comprising: a GSM PIFA antenna element comprising: a first section having a feed pin and a ground pin, a 180 degree U bend connecting the first section to a second section that extends parallel to the first section, a 90 degree bend connecting the second section to a third section, and a WCDMA PIFA antenna element comprising: a first part having a feed pin and a ground pin that extends parallel to the third section of the GSM PIFA antenna element, a 90 degree bend connecting the first part to a second part that extends parallel to the second section of the GSM PIFA antenna element.

Typically the distance between the first part of the WCDMA PIFA antenna element and the third section of the GSM PIFA antenna element is much smaller than the distance between the second part of the WCDMA PIFA antenna element and the second section of the GSM PIFA antenna element.

The antenna arrangement may further comprise a GSM parasitic antenna element having a ground pin and extending parallel to the first section of the GSM PIFA antenna element. Electric currents generated in the first part of the WCDMA PIFA antenna element and in the third section of the GSM PIFA antenna element may travel in substantially the same directions at substantially the same times and electric currents generated in the parasitic antenna element and in the first section of the GSM PIFA antenna element may travel in substantially the same directions at substantially the same times.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
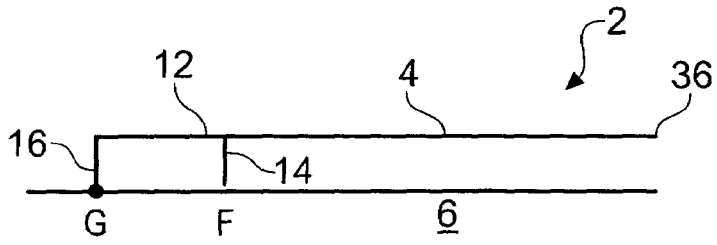
FIG. 1 schematically illustrates a Planar Inverted F antenna (PIFA) 2.

FIG. 1 schematically illustrates a planer inverted F antenna (PIFA) 2. The antenna 2 comprises an antenna element 4, and a ground plane 6. The antenna element 4 has a feed pin 14 and a ground pin 16 at a first part 12 and extends to a free end 36 where it terminates. The ground pin 16 connects the antenna element 4 to the ground plane 6. The feed pin 14 provides a signal for driving the antenna 4. The antenna element 4, being a PIFA, is planer and typically lies within a plane that is parallel to the ground plane 6.

The antenna 2 has at least two resonant modes of operation. The first resonant mode is the lowest frequency resonant mode. It corresponds to a $\lambda/4$ resonant mode of the PIFA. The second resonant mode is the second lowest frequency resonant mode of the antenna. It corresponds to the 3λ/4 resonant mode of the PIFA. Consequently, in the first resonant mode, the antenna 2 has a resonant frequency that corresponds to a wavelength $\lambda_1$, where $\lambda_1$=4L, L being the electrical length of the antenna element 4. In the second resonant mode, there is a resonant frequency corresponding to a wavelength $\lambda_2$ equal to 4L/3.

The electrical length will differ from the physical length because of capacitive and/or inductive loading of the antenna element 4. This may be inherent because of, for example, the capacitance arising from the separation between the antenna element 4 and the ground plane 6. However, it may also be modified by, for example, widening the antenna element in areas of high electric field and narrowing the antenna element or introducing bends in areas of high magnetic field strength H.

Figure 2A:
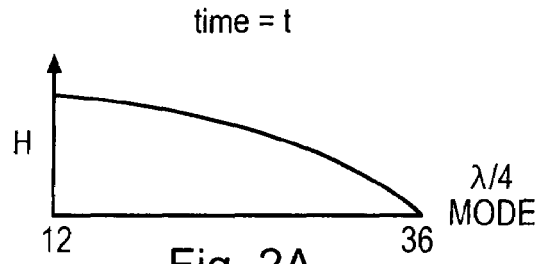
FIGS. 2A, 2B & 2C illustrates how the magnitude of the Magnetic Field Strength (H), the magnitude of the Electric Field (E) & the electric current (I) vary along the electrical length of the antenna element at the lowest resonant mode at time t.

FIG. 2A illustrates how the magnitude of the magnetic field strength (H) varies along the electrical length of the antenna element 4 at the lowest resonant mode at time t. It can be seen that the magnitude of the magnetic field strength H is maximum at the grounded first part 12 and is zero at the terminating free end 36. It varies sinusoidally between these ends of the antenna element 4 with the electrical length of the antenna element 4 corresponding to a quarter wavelength of the sinusoid.

Figure 2B:
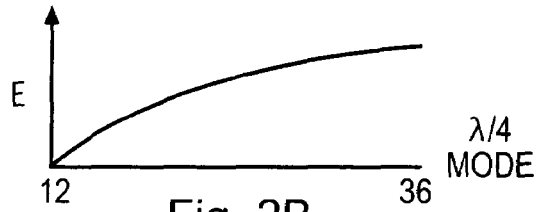

FIG. 2B illustrates how the magnitude of the electric field (E) varies along the electrical length of the antenna element 4 at the lowest resonant mode at time t. The electric field E is 90° out of phase with the magnetic field strength H. The magnitude of the electric field is zero at the grounded first part 12 and is maximum at the terminating free end 36. It varies sinusoidally between these ends of the antenna element with the electrical length of the antenna element 4 corresponding to a quarter wave length of the sinusoid.

Figure 2C:
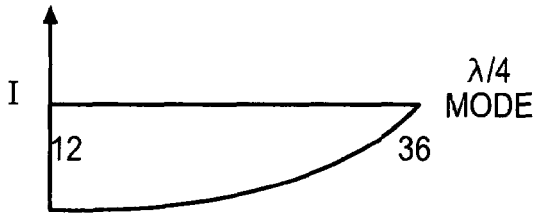

FIG. 2C illustrates how the electric current (I) varies along the electrical length of the antenna element 4 at the lowest resonant mode at time t. It flows towards the ground pin for its length.

Figure 3A:
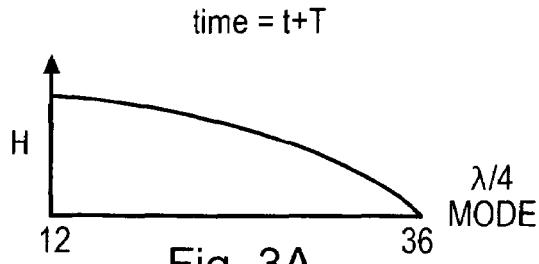
FIGS. 3A, 3B & 3C illustrates how the magnitude of the Magnetic Field Strength (H), the magnitude of the Electric Field (E) & the electric current (I) vary along the electrical length of the antenna element at the lowest resonant mode at time t+T.

FIG. 3A illustrates how the magnetic field strength (H) varies along the length of the antenna element 4 at the lowest resonant mode at time t+T, where T corresponds to $\frac{1}{2}f_1$. $f_1$ is the resonant frequency at the lowest resonant mode. It can be seen that the magnitude of the magnetic field strength H is a maximum at the grounded first part 12 and is zero at the terminating free end 36. It varies sinusoidally between these ends of the antenna element with the electrical length of the antenna element 4 corresponding to a quarter wave length of the sinusoid.

Figure 3B:
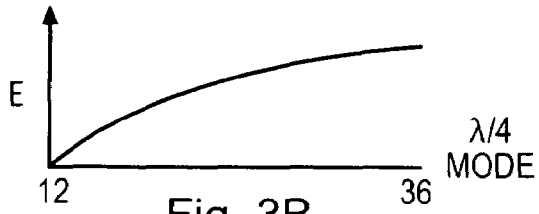

FIG. 3B illustrates how the electric field (E) varies along the length of the antenna element 4 at the lowest resonant mode at time t+T. The electric field E is 90° out of phase with the magnetic field strength H. The magnitude of the electric field is zero at the grounded first part 12 and is maximum at the terminating free end 36. It varies sinusoidally between these ends of the antenna element with the electrical length of the antenna element 4 corresponding to a quarter wave length of the sinusoid.

Figure 3C:
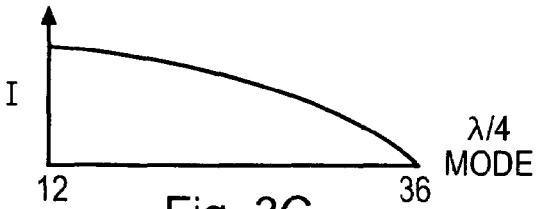

FIG. 3C illustrates how the electric current (I) varies along the electrical length of the antenna element 4 at the lowest resonant mode at time t+T. It flows away from the ground pin for its length.

Figure 4A:
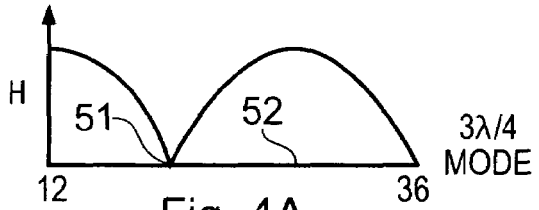
FIGS. 4A, 4B & 4C illustrates how the magnitude of the Magnetic Field Strength (H), the magnitude of the Electric Field (E) & the electric current (I) vary along the electrical length of the antenna element at the second lowest resonant mode at time t.

The FIG. 4A illustrates how the magnitude of the magnetic field strength (H) varies along the length of the antenna element 4 at the second lowest resonant mode, the 3λ/4 mode, at time t. As in FIG. 2A, the H field varies sinusoidally along the length of the antenna element 4. However, the electrical length of the antenna element 4 in this resonant mode corresponds to ¾ of the wavelength of the sinusoid. The magnitude of the magnetic field strength H is maximum at the grounded first part 12 and is zero at the first point 51 one third of the way along the antenna element 4 from the ground pin 16, is maximum at the second point 52 two thirds of the way along the antenna element 4 from the ground pin 16 and is zero at the terminating end 36 of the antenna element 4.

Figure 4B:
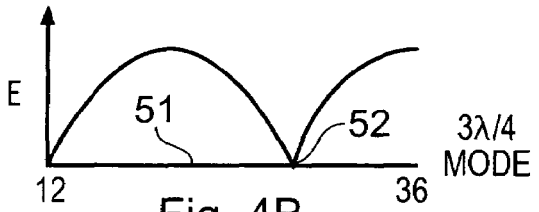

FIG. 4B illustrates how the magnitude of the electric field (E) varies along the length of the antenna element 4 at the second lowest resonant mode at time t. The electric field in FIG. 4B is 90° out of phase with the magnetic field strength H in FIG. 4A. The magnitude of the electric field E is zero at the grounded first part 12, is maximum at the first point 51, is zero at the second point 52 and is maximum at the terminating end 36.

Figure 4C:
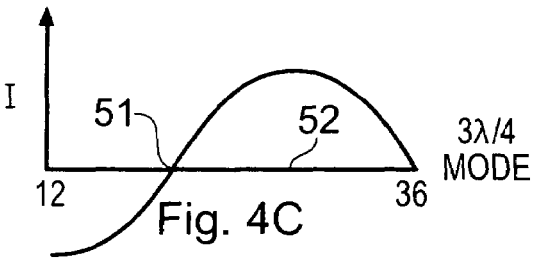

FIG. 4C illustrates how the electric current (I) varies along the length of the antenna element 4 at the second lowest resonant mode at time t. It flows towards the ground pin from the first point 51 and from the first point 51 towards the terminating end 36.

The electric current at the lowest resonant mode varies as: $-\cos(2\pi f_1 t+\pi x/2L)$. The current distribution at time t, varies as $-\cos(\pi x/2L)$. The current distribution at time t+T, varies as $-\cos(\pi+\pi x/2L)$, i.e. $\cos(\pi x/2L)$.

The electric current at the second lowest resonant mode varies as: $-\cos(2\pi f_2 t+3\pi x/2L)$. The current distribution at time t, varies as $-\cos(3\pi x/2L)$. The current distribution at time t+T, varies as $-\cos(\pi+3\pi x/2L)$, i.e. $\cos(3\pi x/2L)$.

Figure 5:
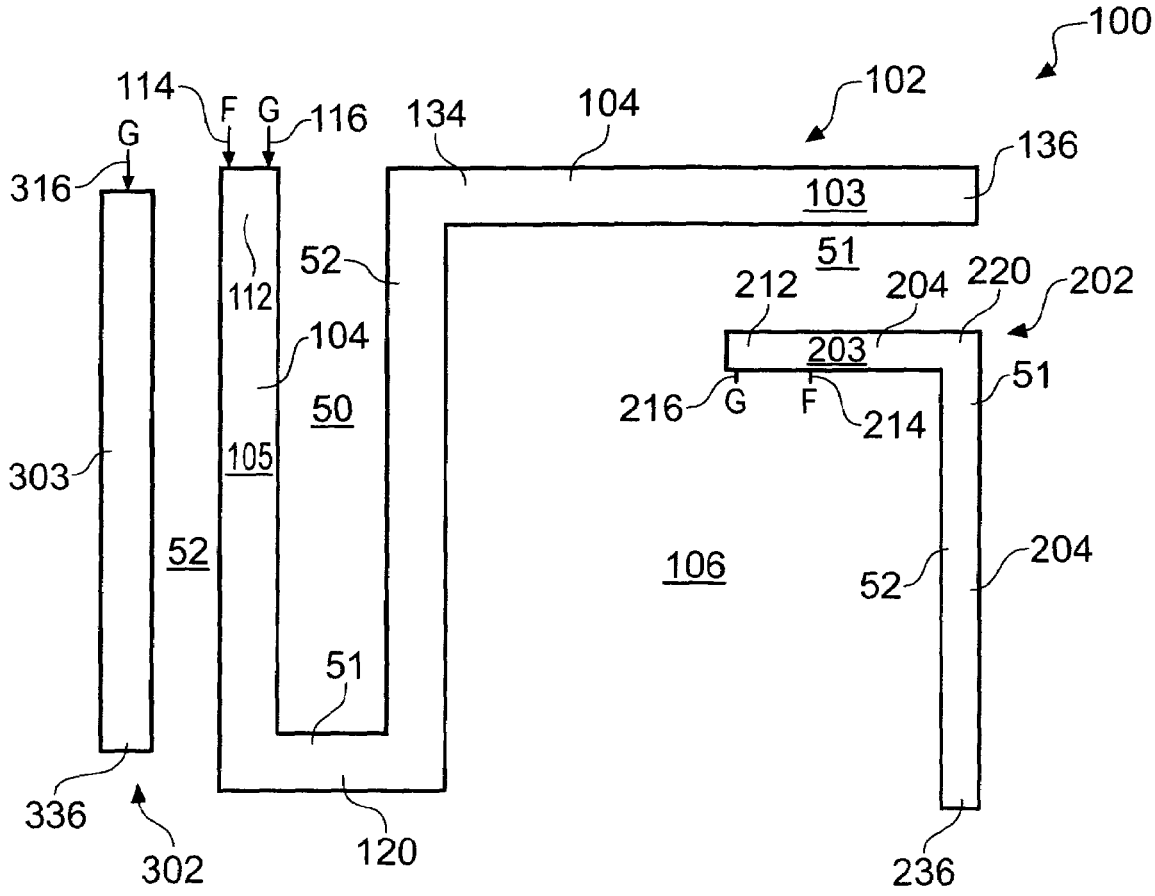
FIG. 5 illustrates a dual mode antenna arrangement.

FIG. 5 illustrates a dual-mode antenna arrangement 100 that comprises a first PIFA antenna 102, a second PIFA antenna 202 and a parasitic antenna element 302. This antenna arrangement 100 is operable as a 2G and a 3G antenna.

The first PIFA antenna 102 is a multi-band antenna covering at its lowest resonant mode US-GSM 850 (824-894 MHz) or EGSM 900 (880-960 MHz) and at its second lowest resonant mode PCN/DCS1800 (1710-1880 MHz). The second PIFA antenna 202 covers the US-WCDMA1900 (1850-1990) band or the WCDMA21000 band (Tx: 1920-19801 Rx: 2110-2180) at its lowest resonant mode. The parasitic antenna element 302 covers the PCS1900 (1850-1990 MHz) band at its resonant mode.

The arrangement may alternatively be designed so that the first PIFA antenna 102 is a multi-band antenna covering at its lowest resonant mode US-GSM 850 (824-894 MHz) or EGSM 900 (880-960 MHz) and at its second lowest resonant mode PCS1900 (1850-1990 MHz). The second PIFA antenna 202 covers the US-WCDMA1900 (1850-1990) band at its lowest resonant mode. The parasitic antenna element 302 covers the PCN/DCS1800 (1710-1880 MHz) band at its resonant mode.

The first PIFA antenna 102 comprises an antenna element 104, and a ground plane 106. The antenna element 104 has a feed pin 114 and a ground pin 116 at a grounded part 112 and extends to a free end 136 where it terminates. The ground pin 116 connects the antenna element 104 to the ground plane 106. The feed pin 114 provides a signal for driving the antenna 104. The antenna element 104, being a PIFA, is planer and typically lies within a first plane that is parallel to the ground plane 106.

The antenna element 104 extends in a first straight section from the grounded part 112 to a first bend 120, turns through 180 degrees through the first bend, extends in a second straight section, parallel to the first straight section, to a second bend 134, turns 90 degrees away from the first straight section through the second bend 34 and extends in a third straight section to terminate at the terminating free end 136. A narrow gap 50 separates the first straight section from the second straight section.

The 90 degree second bend 134 positions the terminating free end 136 far from the first straight section. This improves the radiating efficiency of the first PIFA antenna 102 because in the first resonant mode and the second resonant mode the electric field E is a maximum at the terminating free end 36 (see FIGS. 2B, 3B and 4B). It should be appreciated that the second bend 134 may alternatively be located in a different position and have a different value.

The described geometry in which the first bend 120 is a 180° U bend and the first straight section and the second straight section run parallel to each other separated by a narrow gap 50 reduces the area occupied by the first PIFA antenna 102. A feature of this geometry, is that the parts of the antenna element 4 (112, 52) where the H field (current density) is very large in the second resonant mode are close together and oppose one another across the narrow gap 50. The coupling arising from the proximity of the large H field (current density) reduces the impedance of the first PIFA antenna 102 in the second lowest resonant mode. It should also be appreciated that other geometries are possible that also bring the parts of the first PIFA antenna 102 where the H field is very large/maximum close together.

The electrical length of the first straight section, the first bend 120 and the second straight section corresponds to half the wavelength of the sinusoid in FIGS. 4A-4C. That is the electrical length between the grounded portion 112 and the second point 52 opposing the grounded portion 112 across the gap 50 corresponds to $\lambda_2/2$, where $\lambda_2$ is the wavelength corresponding to the resonant frequency $f_2$ at the second lowest resonant mode. The electrical length of the third straight section to the terminating free end 36 corresponds to $\lambda_2/4$.

The second PIFA antenna 202 comprises an antenna element 204, and the ground plane 106. The antenna element 204 has a feed pin 214 and a ground pin 216 at a grounded part 212 and extends to a free end 236 where it terminates. The ground pin 216 connects the antenna element 204 to the ground plane 106. The feed pin 214 provides a signal for driving the antenna 204. The antenna element 204, being a PIFA, is planer and typically lies within the first plane that is parallel to the ground plane 106.

The antenna element 204 extends in a first straight section from the grounded part 112 to a first bend 220, turns 90 degrees through the first bend, and extends in a second straight section to terminate at the terminating free end 236.

FIGS. 1 and 5 illustrate that the feed pins 114 and 214 of the first PIFA antenna 102 and the second PIFA antenna 202 are in direct contact (a direct feed arrangement) with the antenna elements 104 and 204 respectively. It will be appreciated that in an alternative arrangement the feed pin 114 of the first PIFA 102 and/or the feed pin 214 of the second PIFA 202 need not be in direct contact with the antenna elements 104 and 204 respectively (an indirect feed arrangement); they may be electromagnetically coupled to the antenna elements 104 and 204 respectively. The indirect feeding of a PIFA antenna is commonly known as a PILA (Planar Inverted L antenna)

The FIGS. 2A-2C, 3A-3C schematically illustrate the variation of H, E and I along the length of a PIFA antenna and consequently also show the variation of H, E and I along the length of the first PIFA antenna 102 and the second PIFA antenna 202. The references 12, 36 in FIGS. 2, 3, 4 correspond to the respective references 212, 236 & 112, 136 in FIG. 5.

The first PIFA antenna 102 and the second PIFA antenna 202 are arranged so that a first portion 103 of the first PIFA antenna 102 and a second portion 203 of the second PIFA antenna 202 run in parallel separated by a gap 51 and so that electric currents generated in the first portion 103 and the second portion 203 travel in substantially the same directions at substantially the same times. This increases the isolation between the first PIFA antenna 102 and the second PIFA antenna 202. Typically the isolation is greater than 10-dB.

In the illustrated example, the first portion 103 is part of the third straight section of the first PIFA antenna 102 i.e. the section between the second bend 134 and the terminating free end 136. In this example, the first portion 103 includes part of the last ⅓ of the first PIFA antenna 102. In the illustrated example, the second portion 203 is the first straight section of the second PIFA antenna 202 i.e. the section between the ground pin 216 and the first bend 220. In this example, the second portion 203 includes a significant portion of the first ⅓ of the second PIFA antenna 202.

The ground pin 116 of the first PIFA antenna 102 and the ground pin 216 of the second PIFA antenna 202 are positioned so that there is a 180 degree phase lag, at the second lowest resonant mode of the first PIFA antenna 102, between them via the ground plane 106. This phase lag corresponds to T. It should be appreciated that although it may be beneficial to have an exact 180 degree phase lag, this is not strictly necessary. The electric current in the first PIFA antenna 102 at time t is graphed in FIG. 2C (for the lowest resonant mode) and FIG. 4C (for the second lowest resonant mode). The electric current in the second PIFA antenna 202 at the same time t is graphed in FIG. 3C.

At the lowest resonant mode of the second PIFA antenna 202, at time t, the electric current flows away from the ground pin for its whole length (FIG. 3C). At the first PIFA antenna's second lowest resonant mode, at time t, the electric current flows towards the ground pin from the first point 51 and from the first point 51 to the terminating free end 236 (FIG. 4C). Consequently the electric current in the first portion 103 of the first PIFA antenna 102 and the second portion 203 of the second PIFA antenna 202 flow in parallel in the same direction.

At the lowest resonant mode of the second PIFA antenna 202, at time t+T, the electric current flows towards the ground pin for its whole length (FIG. 2C). At the first PIFA antenna's second lowest resonant mode, at time t+T the electric current flows from the ground pin to the first point 51 and to the first point 51 from the terminating free end 236. Consequently the electric current in the first portion 103 of the first PIFA antenna 102 and the second portion 203 of the second PIFA antenna 202 flow in parallel in the same direction, and are in phase.

The sense of the first portion 103 and second portion 203 are the same, that is, in FIG. 5 they both extend from left to right from the ground pin/towards the terminating free end. The electric current illustrated in FIG. 4C is positive between the first point 51 and the terminating free end 136. The first portion 103 may consequently be positioned anywhere along this region. The second portion 203 would then be positioned parallel to the first portion 103 but the phase lag between the ground pins of the first and second PIFA antennas would be kept at 180 degrees.

If the sense of the first portion 103 and second portion 203 are made opposite. Then a phase difference of 360 degrees would need to separate the ground pins of the first and second antennas to maintain phase between the electric currents in the first and second portions.

The parasitic antenna element 302 has ground pin 316 and extends along a straight section to a free end 336 where it terminates. The ground pin 316 connects the parasitic antenna element 302 to the ground plane 106. The parasitic antenna element 302 is planer and typically lies within the first plane that is parallel to the ground plane 106.

The first PIFA antenna 102 and the parasitic antenna element 302 are arranged so that a portion 105 of the first PIFA antenna 102 and a portion 303 of the parasitic antenna element 302 run in parallel separated by a gap 52 and so that electric currents generated in the portion 105 and the portion 303 travel in substantially the same directions at substantially the same times. This increases the isolation between the first PIFA antenna 102 and the parasitic antenna element 302 and between the second PIFA antenna 202 and the parasitic element 302.

The ground pin 316 of the parasitic antenna element 302 and the ground pin 116 of the first PIFA antenna element 102 are in close proximity so that the lag introduced between them is substantially zero.

Figure 6:
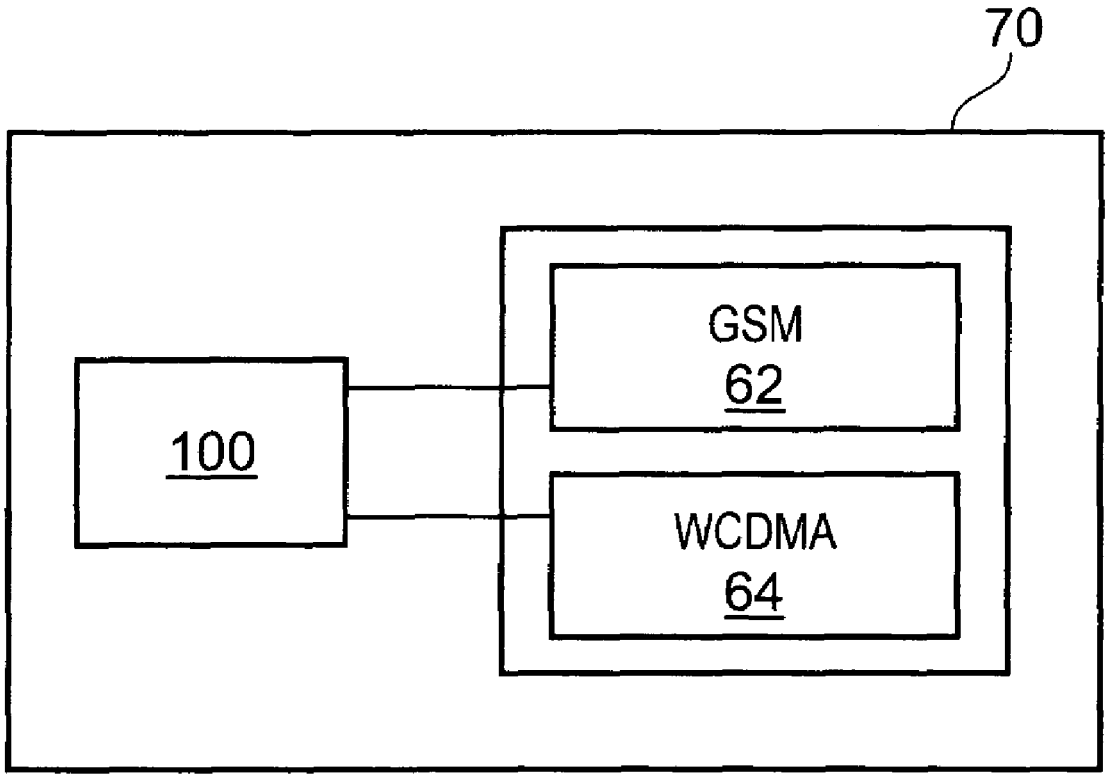
FIG. 6 illustrates a dual mode radio communications device.

FIG. 6 illustrates a dual mode radio communications device 70 such as a mobile telephone, comprising an internal antenna arrangement 100 and GSM radio frequency circuitry 62 feeding the first PIFA antenna 102 and WCDMA radio frequency circuitry 64 feeding the second PIFA antenna 202.

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An antenna arrangement comprising:

a first antenna element having a first radiating portion and a first feed; and a second antenna element having a second radiating portion and a second feed, different to the first feed, wherein the first antenna element and the second antenna element are relatively arranged and oriented within a first plane so that the first radiating portion and the second radiating portion run in parallel, so that electric currents generated in the first radiating portion and the second radiating portion travel in substantially the same directions at substantially the sane times.

2. An antenna arrangement as claimed in claim 1, wherein the electric currents in the first radiating portion and second radiating portion are in phase.

3. An antenna arrangement as claimed in claim 1, wherein the first radiating portion and second radiating portion are straight.

4. An antenna arrangement as claimed in claim 1, wherein the first antenna element has a first ground pin connected to a ground plane and the second antenna element has a second ground pin connected to the ground plane and wherein the first and second ground pins are separated by a distance such that the electric current in the first portion and the electric current in the second portion navel in the same direction at the same time.

5. An antenna arrangement as claimed in claim 1, wherein the first and second antenna elements are PIFA.

6. An antenna arrangement as claimed in claim 1, wherein the first PIFA operates in the PCS1900 (1850-1990 MHz) band and the second PIFA operates in the US-WCDMA1900 (1850-1990) band or WCDMA2100 band.

7. An antenna arrangement as claimed in claim 1, wherein one of the first and second antenna elements is a PIFA and the other is a parasitic element.

8. An antenna arrangement as claimed in claim 7, wherein the parasitic element operates in the PCS1900 (1850-1990 MHz) band.

9. An antenna arrangement as claimed in claim 1, wherein one of the first and second antenna elements is a PIFA and the other is a PILA.

10. A radio communications device comprising an antenna arrangement as in claim 1.

11. An antenna arrangement, comprising:

first antenna element having a first portion and a first feed; and a second antenna element having a second portion and a second feed, different to the first feed, wherein the first antenna element and the second antenna element are relatively arranged and oriented so that the first portion and the second portion run in parallel, and so that electric currents generated in the first portion and the second portion travel in substantially the same directions at substantially the same times;

wherein the first antenna element has a first ground pin connected to a ground plane and the second antenna element has a second ground pin connected to the ground plane and wherein the first and second ground pins are separated by a distance such that the electric current in the first portion and the electric current in the second portion travel in the same direction at the same time; and wherein the separation between the first and second ground pins is equivalent to a phase lag of 180*N degrees in the electric currents at the first and second ground pins, where N is an integer.

12. An antenna arrangement comprising:

a first antenna element having a first radiating portion and a first feed; and a second antenna element having a second radiating portion and a second feed, different to the first feed, wherein the first antenna element and the second antenna element are relatively arranged and oriented so that the first radiating portion and the second radiating portion run in parallel, so that electric currents generated in the first radiating portion and the second radiating portion travel in substantially the same directions at substantially the same times, wherein the first antenna element extends from a first grounded end to a first terminating free end; and the first radiating portion is located in the two thirds of the first antenna element nearest the first terminating free end and extends in a first sense from a part of the first radiating portion nearest tire first grounded end to a part nearest the first terminating end, and wherein the second antenna element extends from a second grounded end through the second radiating portion to a second terminating free end, the second radiating portion extending in the first sense.

13. An antenna arrangement as claimed in claim 12, wherein there is a lag of 180 degrees between the grounded ends of the first and second antenna elements.

14. An antenna arrangement as claimed in claim 12, wherein the first radiating portion is located in the one third of the first antenna element nearest the first terminating free end.

15. An antenna arrangement as claimed in claim 14, wherein there is a lag of 180 degrees between the first and second grounded ends of the first and second antenna elements.

16. An antenna arrangement as claimed in claim 12, wherein the second terminating free end is the part of the second antenna element furthest from the first antenna element.

17. An antenna arrangement as claimed in claim 16, wherein the second antenna element bends away from the first antenna element at the part of the second radiating portion furthest from the second grounded end of the second antenna element.

18. An antenna arrangement, comprising:

a first antenna element having a first portion and a first feed; and a second antenna element having a second portion and a second feed, different to the first feed, wherein the first antenna element and the second antenna element are relatively arranged and oriented so that the first portion and the second portion run in parallel, and so that electric currents generated in the first portion and the second portion travel in substantially the same directions at substantially the same times, wherein the first antenna element extends from a first grounded end to a first terminating free end; and the first portion is located in the two thirds of the first antenna element nearest the first terminating free end and extends in a first sense from a part of the first portion nearest the first grounded end to a part nearest the first terminating end, and wherein the second antenna element extends from a second grounded end through the second portion to a second terminating free end, the second portion extending in a second sense apposite to the first direction.

19. An antenna arrangement comprising:

a first antenna element having a first radiating portion and a first feed; and a second antenna element having a second radiating portion and a second feed, different to the first feed, wherein the first antenna element and the second antenna element are relatively arranged and oriented so that the first radiating portion and the second radiating portion run in parallel, so that electric currents generated in the first radiating portion and the second radiating portion travel in substantially the same directions at substantially the same times;

and wherein there is a lag of 360 degrees between grounded ends of the first and second antenna elements.

20. A method comprising:

providing an antenna arrangement, comprising a first antenna element having a first radiating portion and a first feed and a second antenna element having a second radiating portion and a second feed, different to the first feed, wherein the first antenna element and the second antenna element are relatively arranged and oriented within a first plane so that the first radiating portion and the second radiating portion run in parallel; and generating electric current in the first radiating portion and the second radiating portion, where the electric current travels in substantially the same directions at substantially the same times.

21. A method according to claim 20, wherein the electric currents in the first radiating portion and the second radiating portion are in phase.

22. A method according to claim 20, wherein the first radiating portion and the second radiating portion are straight.

23. A method according to claim 20, wherein there is a lag of 360 degrees between grounded ends of the first and second antenna elements.

24. A method according to claim 20, wherein the first antenna element and the second antenna element are planer inverted F antenna elements.

25. A method according to claim 20, wherein one of the first and second antenna elements is a planar inverted F antenna and the other is a parasitic element.

* * * * *

UNITED STATES PATENT AND TRADEMARK OFFICE

CERTIFICATE OF CORRECTION

PATENT NO. : 7,495,620 B2
APPLICATION NO. : 11/101227
DATED : February 24, 2009
INVENTOR(S) : Wang et al.

It is certified that error appears in the above-identified patent and that said Letters Patent is hereby corrected as shown below:

IN THE CLAIMS:

Claim 1, column 7, line 47, please delete “sane” and replace with --same--.

Claim 4, column 7, line 60, please delete “navel” and replace with --travel--.

Claim 12, column 8, line 52, please delete “tire” and replace with --the--.

Claim 18, column 9, line 30, please delete “apposite” and replace with --opposite--.

Signed and Sealed this

Twelfth Day of May, 2009

JOHN DOLL
*Acting Director of the United States Patent and Trademark Office*